US009910400B2

(12) United States Patent
Sato et al.

(10) Patent No.: US 9,910,400 B2
(45) Date of Patent: Mar. 6, 2018

(54) OPENING/CLOSING UNIT AND IMAGE FORMING APPARATUS INCLUDING THE SAME

(71) Applicant: KYOCERA Document Solutions Inc., Osaka (JP)

(72) Inventors: Takehiro Sato, Osaka (JP); Yoshiaki Tashiro, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/438,163

(22) Filed: Feb. 21, 2017

(65) Prior Publication Data

US 2017/0248898 A1 Aug. 31, 2017

(30) Foreign Application Priority Data

Feb. 26, 2016 (JP) ..... 2016-035412

(51) Int. Cl.
*G03G 15/23* (2006.01)
*G03G 21/16* (2006.01)

(52) U.S. Cl.
CPC ..... *G03G 21/1623* (2013.01); *G03G 15/23* (2013.01); *G03G 15/231* (2013.01); *G03G 15/232* (2013.01); *G03G 15/234* (2013.01); *G03G 21/1628* (2013.01); *G03G 21/1633* (2013.01); *G03G 21/1638* (2013.01); *G03G 21/1647* (2013.01); *G03G 21/1695* (2013.01)

(58) Field of Classification Search
CPC .... G03G 15/23; G03G 15/231; G03G 15/232; G03G 15/234; G03G 21/1623; G03G 21/1628; G03G 21/1633; G03G 21/1638; G03G 21/1647; G03G 21/1695; G03G 2221/1651; G03G 2221/1654; G03G 2221/169; G03G 2221/1684; G03G 2221/1687
See application file for complete search history.

(56) References Cited

U.S. PATENT DOCUMENTS

2010/0080627 A1* 4/2010 Takamura ..... G03G 21/1864 399/167
2015/0346640 A1* 12/2015 Takahashi ..... G03G 15/0898 399/98
2016/0154348 A1* 6/2016 Fukase ..... G03G 15/234 399/322

FOREIGN PATENT DOCUMENTS

JP 2012-220546 A 11/2012

* cited by examiner

*Primary Examiner* — Joseph S Wong
(74) *Attorney, Agent, or Firm* — Stein IP, LLC

(57) ABSTRACT

Provided is an opening/closing unit including a cover member and a conveying unit. The cover member is provided to one side surface of an apparatus main body so as to open and close a sheet conveying path. The conveying unit is provided inside of the cover member in the apparatus main body. The sheet conveying path includes a first conveying path formed between the conveying unit and the apparatus main body, and a second conveying path formed between the conveying unit and the cover member. When an operating lever of the cover member is rotated to a second position, opening operation of the cover member is enabled. When the operating lever is rotated to a first position in a state where the cover member is opened, the conveying unit rotates with respect to the cover member so that the second conveying path is opened.

7 Claims, 11 Drawing Sheets

OPENING/CLOSING UNIT AND IMAGE FORMING APPARATUS INCLUDING THE SAME

INCORPORATION BY REFERENCE

This application is based upon and claims the benefit of priority from the corresponding Japanese Patent Application No. 2016-035412 filed Feb. 26, 2016, the entire contents of which are hereby incorporated by reference.

BACKGROUND

The present disclosure relates to an opening/closing unit and an image forming apparatus including the same. In particular, the present disclosure relates to an opening/closing unit including a cover member provided to one side surface of an apparatus main body in a rotatable manner, a conveying unit attached to the inside of the cover member in a rotatable manner, and to an image forming apparatus including the opening/closing unit.

Conventionally, there is known an image forming apparatus including an opening/closing unit that is openable and closable with respect to one side surface of an apparatus main body. Specifically, the opening/closing unit includes a cover member that is rotatable with respect to one side surface of the image forming apparatus main body, and a conveying unit provided inside of the cover member in the apparatus main body in a rotatable manner. Between the conveying unit and the apparatus main body, there is formed a first conveying path for conveying paper (a sheet). Between the conveying unit and the cover member, there is formed a second conveying path that is a double-sided conveying path for reversing and returning the paper sheet to the first conveying path. In this image forming apparatus, by opening the opening/closing unit, the first conveying path is opened so that an unjamming operation of the first conveying path can be performed. In addition, in order to perform an unjamming operation of the second conveying path, the opening/closing unit (the cover member and the conveying unit) is opened, and then the conveying unit is rotated with respect to the cover member. Thus, the second conveying path is opened, and hence an unjamming operation of the second conveying path can be performed.

SUMMARY

In order to achieve the above-mentioned object, an opening/closing unit according to a first structure of the present disclosure includes a cover member and a conveying unit. The cover member is disposed in a rotatable manner with respect to one side surface of an apparatus main body, so as to open and close a sheet conveying path formed in the apparatus main body. The conveying unit is provided inside of the cover member in the apparatus main body in a rotatable manner. The sheet conveying path includes a first conveying path formed between the conveying unit and the apparatus main body so as to convey a sheet, and a second conveying path formed between the conveying unit and the cover member so as to convey a sheet. The cover member includes an operating lever that has a first engaging part capable of engaging with a locking part of the apparatus main body and is rotatable between a first position and a second position, the first position allowing the first engaging part and the locking part to be engaged with each other in a state where the cover member is closed, the second position allowing the engagement between the first engaging part and the locking part to be released in a state where the cover member is closed, a first link mechanism that interlocks with operation of the operating lever, and a first biasing member that biases the conveying unit in a direction in which the second conveying path is opened. The conveying unit includes a second engaging part that engages with the first link mechanism by rotating the operating lever to the second position in a state where at least the second conveying path is not opened. The first link mechanism is positioned at a pressing position for pressing the second engaging part when the operating lever is rotated to the second position and is positioned at a pressure canceling position for canceling to press the second engaging part when the operating lever is rotated to the first position. When the operating lever is rotated to the second position in a state where the cover member is closed, engagement of the first engaging part with the locking part is released so that opening operation of the cover member can be performed. When the operating lever is rotated to the first position in a state where the cover member is opened, engagement of the second engaging part with the first link mechanism can be released, and the conveying unit is rotated with respect to the cover member by a biasing force of the first biasing member, so that the second conveying path is opened.

Further other objects and specific advantages of the present disclosure will become apparent from the description of embodiments given below.

DETAILED DESCRIPTION

Hereinafter, an embodiment of the present disclosure is described with reference to the drawings.

Figure 1:
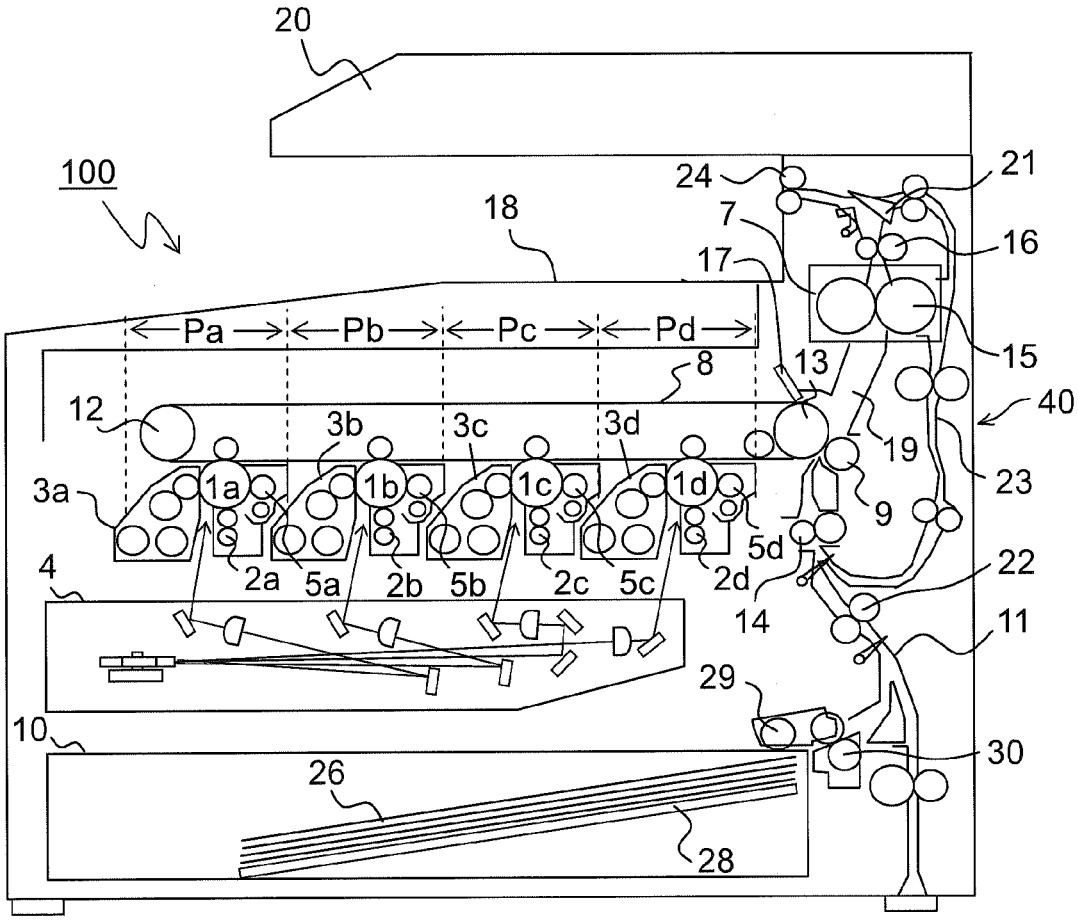
FIG. 1 is a cross-sectional view illustrating an overall structure of an image forming apparatus including an opening/closing unit according to an embodiment of the present disclosure.

With reference to FIGS. 1 to 17, there is described an image forming apparatus 100 including an opening/closing unit 40 according to an embodiment of the present disclosure. As illustrated in FIG. 1, the image forming apparatus 100 is a tandem type color copier. In a main body of the image forming apparatus 100, there are disposed four image forming portions Pa, Pb, Pc and Pd in order from the left side in FIG. 1. The image forming portions Pa to Pd are disposed corresponding to four different color (yellow, magenta, cyan and black) images, so as to form yellow, magenta, cyan and black images in order by the steps of electrification, exposure, development and transfer.

These image forming portions Pa to Pd are provided with photosensitive drums 1*a*, 1*b*, 1*c* and 1*d* for carrying visible images (toner images) of individual colors. Further, an intermediate transfer belt (image carrier) 8, which turns in a counterclockwise direction in FIG. 1, is disposed adjacent to the image forming portions Pa to Pd. The toner images formed on these photosensitive drums 1*a* to 1*d* are sequentially transferred and overlaid on the intermediate transfer belt 8 moving in contact with the photosensitive drums 1*a* to 1*d*, and then by operation of a secondary transfer roller 9 the toner images are transferred onto a paper sheet 26 as an example of a sheet. Further, the toner images are fixed on the paper sheet 26 by a fixing device 7, and then the paper sheet 26 is discharged from the apparatus main body (main body of the image forming apparatus 100). The photosensitive drums 1*a* to 1*d* are rotated in a clockwise direction in FIG. 1 while an image forming process is performed on each of the photosensitive drums 1*a* to 1*d*.

The paper sheet 26 onto which the toner image is to be transferred is housed in a sheet feed cassette 10 disposed in a lower part of the apparatus. The paper sheets 26 are stacked on a sheet stack tray 28 in the sheet feed cassette 10. When a pickup roller 29 rotates in a state where the upper surface of the paper sheet 26 is pressed to the pickup roller 29 with a predetermined pressure, feeding of the paper sheet 26 is started. Then, the uppermost one of the paper sheets 26 is separated by a conveying roller pair 30 and is conveyed toward a paper sheet conveying path 11. The paper sheet 26, which is conveyed by an intermediate conveying roller pair 22 to pass through the paper sheet conveying path 11, reaches a registration roller pair 14 and is conveyed to a nip between the secondary transfer roller 9 and a drive roller 13 of the intermediate transfer belt 8 in synchronization with image formation timing.

As the intermediate transfer belt 8, a sheet made of a dielectric resin is used, and a seamless belt is mainly used. In addition, on the downstream side in the moving direction of the intermediate transfer belt 8 viewed from the secondary transfer roller 9, there is disposed a cleaning blade 17 for removing toner remaining on the surface of the intermediate transfer belt 8.

An image reading portion 20 is constituted of a scanning optical system including a scanner lamp for illuminating a document when performing copying and a mirror for changing an optical path of reflection light from the document, a condensing lens for condensing the reflection light from the document to form an image, a CCD sensor for converting the formed image light into an electric signal, and the like (which are not shown), so as to read a document image and converts it into image data.

Next, the image forming portions Pa to Pd are described. Around and under the photosensitive drums 1*a* to 1*d*, there are disposed electrification devices 2*a*, 2*b*, 2*c* and 2*d*, an exposure device 4, development devices 3*a*, 3*b*, 3*c* and 3*d*, and cleaning devices 5*a*, 5*b*, 5*c* and 5*d*.

When the image data is input from the image reading portion 20, first the electrification devices 2*a* to 2*d* uniformly electrify the surfaces of the photosensitive drums 1*a* to 1*d*, and then the exposure device 4 emits a light beam so as to form electrostatic latent images on the photosensitive drums 1*a* to 1*d*, respectively corresponding to the image data. The development devices 3*a* to 3*d* include development rollers disposed to face the photosensitive drums 1*a* to 1*d*, respectively, and are filled with a predetermined amount of two-component developer containing yellow, magenta, cyan and black toners, respectively. The toner is supplied to the surfaces of the photosensitive drums 1*a* to 1*d* by the development rollers, so as to form toner images corresponding to the electrostatic latent images.

Then, the toner images on the photosensitive drums 1*a* to 1*d* are primarily transferred onto the intermediate transfer belt 8. After that, toner remaining on the surfaces of the photosensitive drums 1*a* to 1*d* is removed by the cleaning devices 5*a* to 5*d*.

The intermediate transfer belt 8 is stretched around a follower roller 12 and the drive roller 13. When the drive roller 13 rotates, the intermediate transfer belt 8 starts to turn in a counterclockwise direction, and the paper sheet 26 is conveyed from the registration roller pair 14 to the nip between the secondary transfer roller 9 and the intermediate transfer belt 8 (secondary transfer nip) at a predetermined timing, and a full color image is secondarily transferred onto the paper sheet 26 in the nip.

The paper sheet 26 is conveyed to the fixing device 7 and is heated and pressed when passing through a nip between a pair of fixing rollers 15 (fixing nip), and thus the toner image is fixed on the surface of the paper sheet 26 so that a predetermined full color image is formed. After that, the paper sheet 26 passes through a conveying roller pair 16, and its conveying direction is switched by a conveyance guide member 21 disposed at a branch part of a paper sheet conveying path 19, so as to be discharged onto a discharge tray 18 by a discharge roller pair 24 as it is (or after being sent to a double-sided conveying path (reverse conveying path) 23 for performing double-sided copying).

Specifically, the paper sheet conveying path 19 branches left and right on the downstream side of the conveying roller pair 16, and one of the paths (the left branching path in FIG. 1) is communicated to the discharge tray 18. Further, the other path (right branching path in FIG. 1) is communicated to the double-sided conveying path 23.

The image forming apparatus 100 of the present disclosure has a structure in which the double-sided conveying path 23 is formed along the backside of the apparatus. The opening/closing unit 40, which constitutes a part of the double-sided conveying path 23, is disposed in an openable and closable manner with respect to one side surface of the apparatus main body (a right side surface in FIG. 1). The opening/closing unit 40 can rock (rotate) about an axis on the lower end and constitutes a part of the paper sheet conveying paths 11 and 19 in a closed state, while it opens the paper sheet conveying paths 11 and 19 in an open state.

Figure 2:
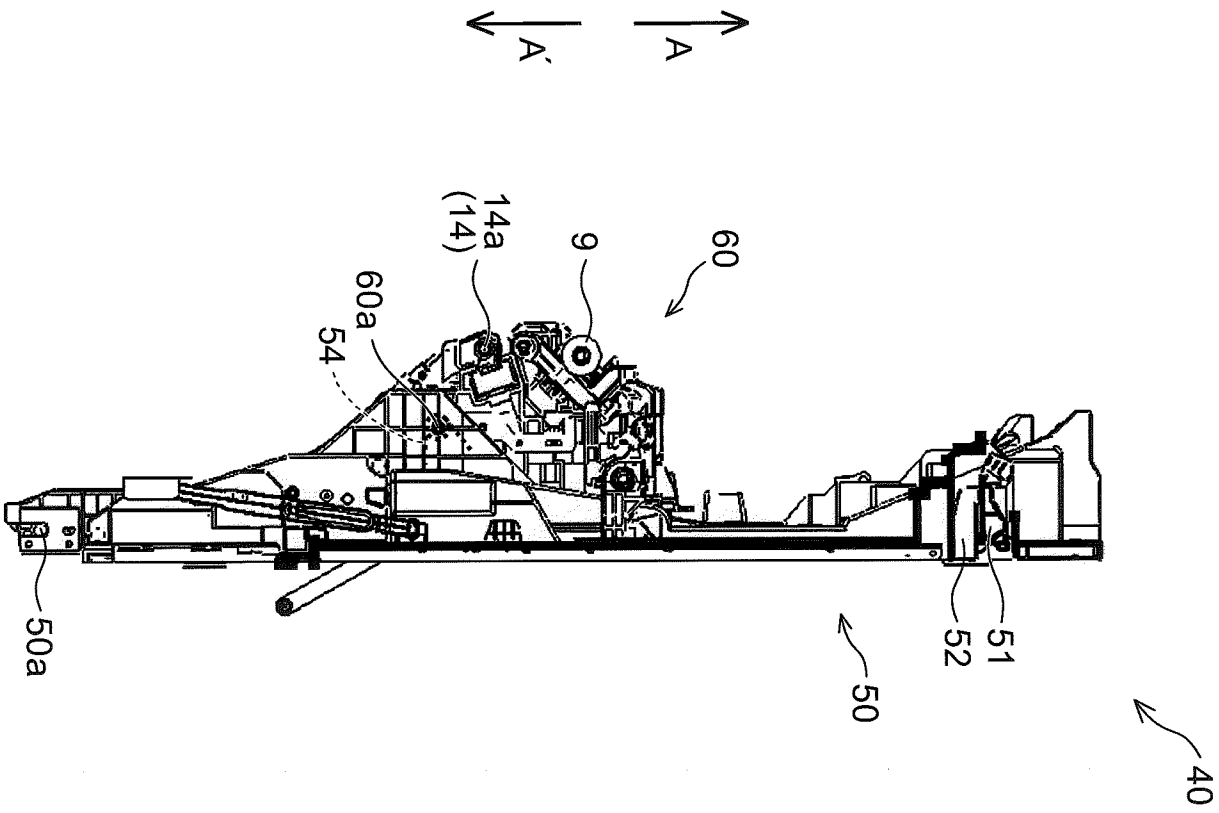
FIG. 2 is a side view illustrating a structure of the opening/closing unit according to an embodiment of the present disclosure.
Figure 3:
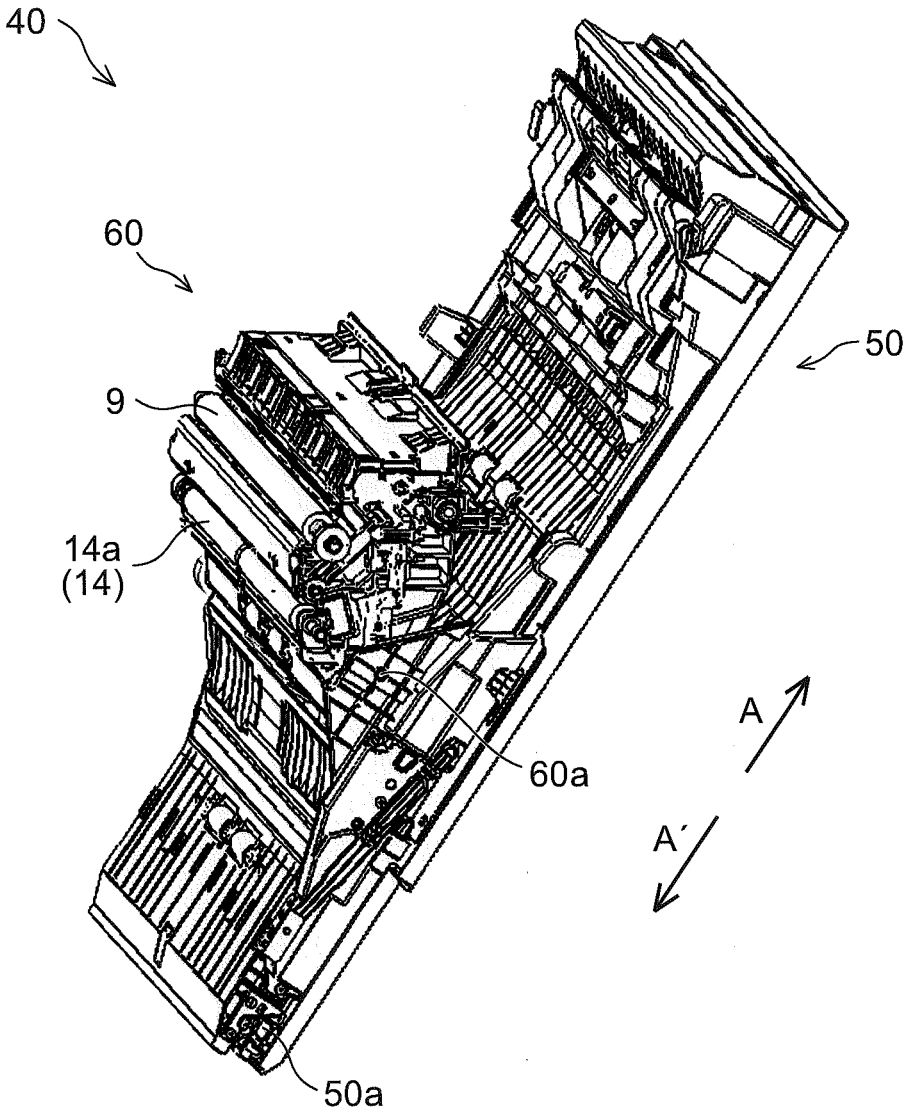
FIG. 3 is a perspective view illustrating an open state of the opening/closing unit according to an embodiment of the present disclosure.

As illustrated in FIGS. 2 and 3, the opening/closing unit 40 is constituted of a cover member 50 disposed in a rotatable manner with respect to one side surface of the apparatus main body and a conveying unit 60 attached to the cover member 50 in a rotatable manner. The conveying unit 60 and the apparatus main body constitute a part of the paper sheet conveying path 19 (a sheet conveying path, a first conveying path, and a first sheet conveying path), while the conveying unit 60 and the cover member 50 constitute a part of the double-sided conveying path 23 (the sheet conveying path, a second conveying path, and a second sheet conveying path).

The cover member 50 can rotate (open and close) about a rotation shaft 50*a* disposed at the lower end with respect to the apparatus main body. The conveying unit 60 can rotate (open and close) about a rotation shaft 60*a* disposed at the lower end with respect to the cover member 50. When the cover member 50 and the conveying unit 60 rotates about the rotation shaft 50*a* in a clockwise direction from the state of FIG. 2 (closed state), the paper sheet conveying path 19 is opened. When the conveying unit 60 rotates about the rotation shaft 60*a* in a counterclockwise direction with respect to the cover member 50, the double-sided conveying path 23 is opened.

Figure 4:
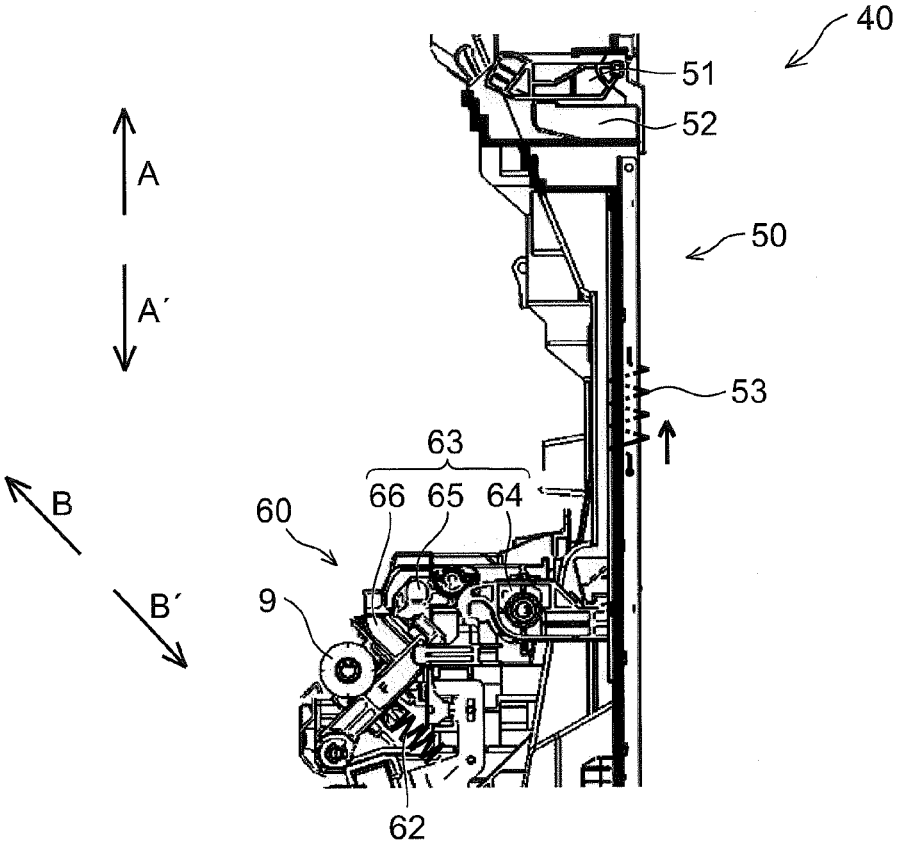
FIG. 4 is a diagram illustrating a structure of an operating lever, a first link mechanism, a second link mechanism, and their periphery of the opening/closing unit according to an embodiment of the present disclosure, in a state where the cover member is closed and the operating lever is not operated.
Figure 5:
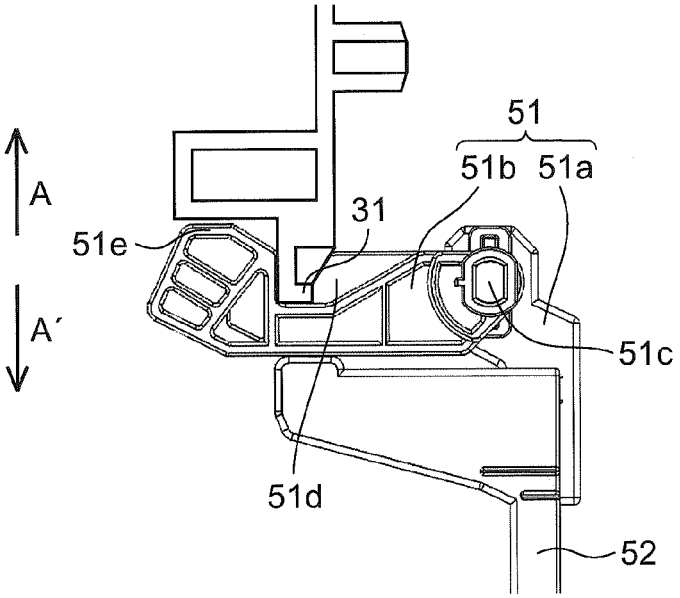
FIG. 5 is a diagram illustrating a structure of the operating lever and its periphery of the opening/closing unit according to an embodiment of the present disclosure, in a state where the cover member is closed and the operating lever is not operated.

As illustrated in FIGS. 4 and 5, the cover member 50 is provided with an operating lever (locking member) 51 that is disposed on the upper part and is operated by a user for opening the cover member 50, a first link mechanism 52 that interlocks with the operation of the operating lever 51, an extension spring 53 that biases the first link mechanism 52 in an arrow A direction (an upward direction in the closed state of the cover member 50, a second direction), a torsion spring (first biasing member) 54 (see FIG. 2) disposed on both ends of the rotation shaft 60*a* so as to bias the conveying unit 60 in a direction in which the double-sided conveying path 23 is opened (in a counterclockwise direction in FIG. 2).

As illustrated in FIG. 5, the operating lever 51 is constituted of a handle 51*a* that is grasped by a finger when a user opens the cover member 50, an engaging member 51*b* attached to the handle 51*a*, and a rotation shaft 51*c*. The handle 51*a* is configured to be rotatable about the rotation shaft 51*c* and is attached to a middle part of the rotation shaft 51*c* in the longitudinal direction (perpendicular to the paper surface of FIG. 5). The engaging member 51*b* is attached to both ends of the rotation shaft 51*c* and rotates together with the handle 51*a* about the rotation shaft 51*c*.

The engaging member 51*b* is provided with an engagement recess (first engaging part) 51*d* that can engage with a locking part 31 of the apparatus main body, and a distal end part (abutting part) 51*e* disposed adjacent to the apparatus inside of the engagement recess 51*d* (the left side in FIG. 5) so as to be capable of abutting the locking part 31. The engagement recess 51*d* is positioned at the first position (the position of FIG. 5) in a state where the cover member 50 is closed and the operating lever 51 is not operated (hereinafter referred to as an initial state) so as to engage with the locking part 31. Note that, in this initial state (the state of FIG. 5), the engaging member 51*b* is positioned so that the bottom surface becomes horizontal (perpendicular to the arrow A direction). On the other hand, when the operating lever 51 is operated (rotated in a counterclockwise direction in FIG. 5) in a state where the cover member 50 is closed, the engagement recess 51*d* is positioned at the second position (the position of FIG. 6), and engagement between the engagement recess 51*d* and the locking part 31 is released.

Figure 7:
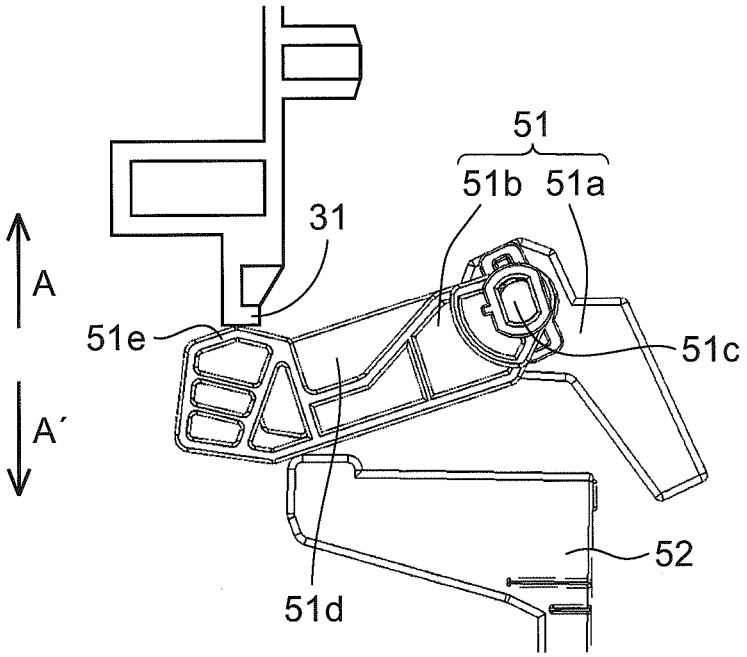
FIG. 7 is a diagram illustrating a structure of the operating lever and its periphery of the opening/closing unit according to an embodiment of the present disclosure, in a state where the operation of the operating lever is canceled during opening operation of the cover member.
Figure 8:
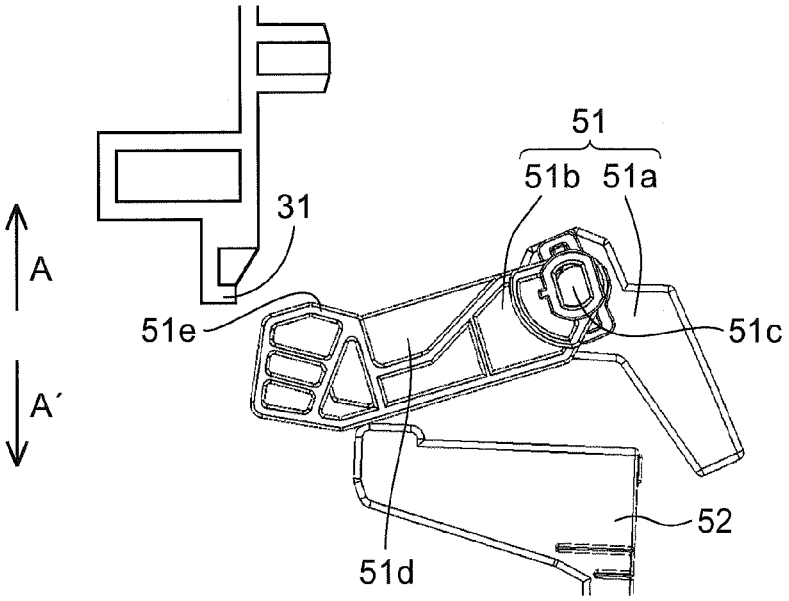
FIG. 8 is a diagram illustrating a structure of the operating lever and its periphery of the opening/closing unit according to an embodiment of the present disclosure, in a state where the cover member is opened to a certain angle or larger.

The distal end part 51*e* can abut the lower end of the locking part 31 as illustrated in FIG. 7, and it restricts the rotation of the operating lever 51 in a counterclockwise direction from returning to an original state (a position at which the bottom surface becomes horizontal, the first position) by the upward pressure of the first link mechanism 52, until the cover member 50 is opened to a certain angle or larger. In addition, when the cover member 50 is opened to the certain angle or larger as illustrated in FIG. 8, the distal end part 51*e* becomes unable to abut the locking part 31 (becomes unrestricted). The restriction period by this locking part 31 can be set by a length of the distal end part 51*e* in the left and right direction in FIG. 8. In this embodiment, the restriction period is until a rotation shaft of the secondary transfer roller (a roller member, a moving member) 9 gets over a support member 32 described later (until it becomes unable to return to the inside of an opening part 32*a* of the support member 32 described later).

Figure 6:
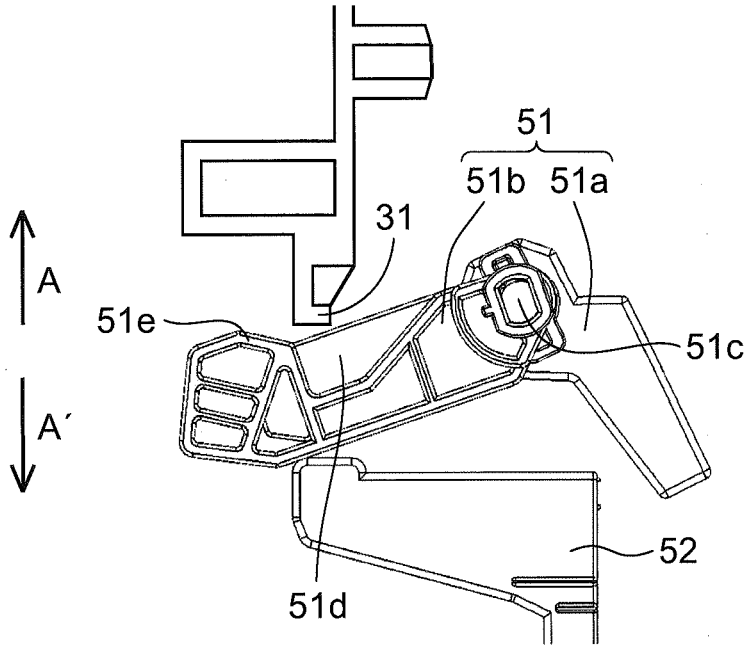
FIG. 6 is a diagram illustrating a structure of the operating lever and its periphery of the opening/closing unit according to an embodiment of the present disclosure, in a state where the cover member is closed and the operating lever is operated.
Figure 9:
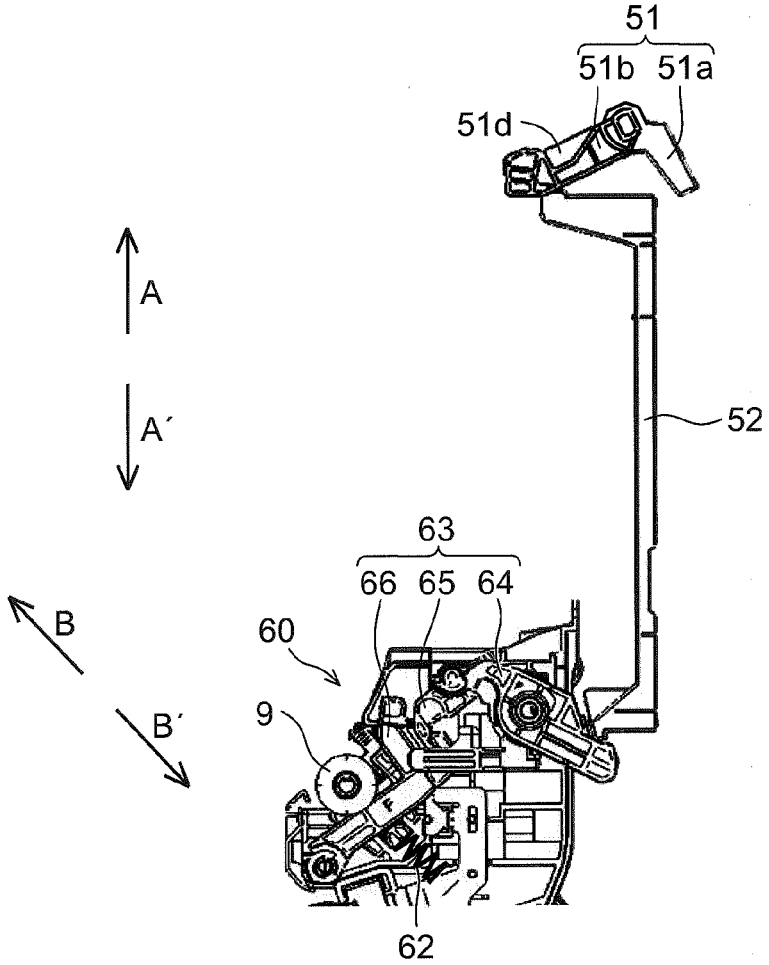
FIG. 9 is a diagram illustrating a structure of the operating lever, the first link mechanism, the second link mechanism, and their periphery of the opening/closing unit according to an embodiment of the present disclosure, in a state where the operating lever is operated.
Figure 10:
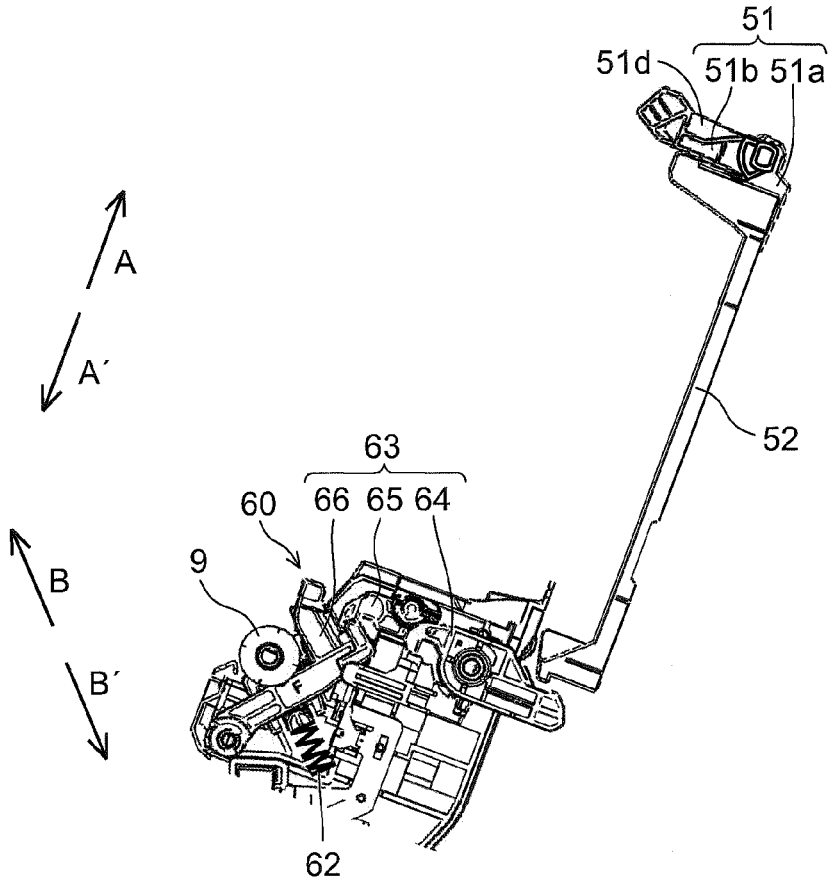
FIG. 10 is a diagram illustrating a structure of the operating lever, the first link mechanism, the second link mechanism, and their periphery of the opening/closing unit according to an embodiment of the present disclosure, in a state where the operation of the operating lever is canceled in a state where the cover member is opened to a certain angle or larger.
Figure 11:
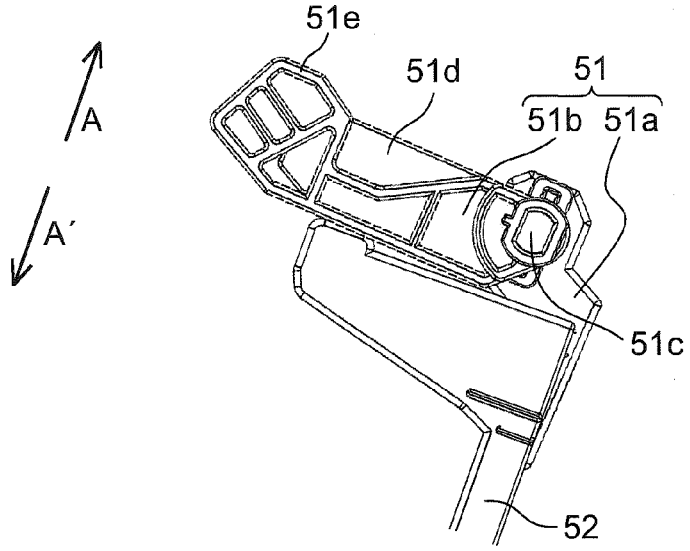
FIG. 11 is a diagram illustrating a structure of the operating lever and its periphery of the opening/closing unit according to an embodiment of the present disclosure, in a state where the operation of the operating lever is canceled in a state where the cover member is opened to a certain angle or larger.

The first link mechanism 52 is biased in the arrow A direction by the extension spring 53 so as to normally press the underside of the engaging member 51*b* of the operating lever 51 in the arrow A direction (the upward direction parallel to the outer surface of the cover member 50). In the initial state (the states of FIGS. 2 and 5), the first link mechanism 52 is positioned at a position at which the underside of the engaging member 51*b* becomes horizontal (initial position). On the other hand, when the operating lever 51 is operated (when the handle 51*a* in FIG. 5 is rotated in a counterclockwise direction), the first link mechanism 52 is pressed by the engaging member 51*b* to move in an arrow A' direction (the downward direction parallel to the outer surface of the cover member 50), as illustrated in FIGS. 6 and 9. In addition, when the operation of the operating lever 51 is canceled in a state where the cover member 50 is opened to the certain angle or larger (in a state where the engaging member 51*b* has passed the locking part 31), the engaging member 51*b* rotates a little about the rotation shaft 51*c* from the initial state (the state of FIG. 5) in a clockwise direction, and the first link mechanism 52 moves a little from the initial state (initial position) in the arrow A direction, as illustrated in FIGS. 10 and 11. Note that the cover member 50 is provided with a restricting part (not shown) that abuts the engaging member 51*b* so as to restrict the rotation in a clockwise direction when the engaging member 51*b* rotates a little from the initial position in a clockwise direction.

Figure 12:
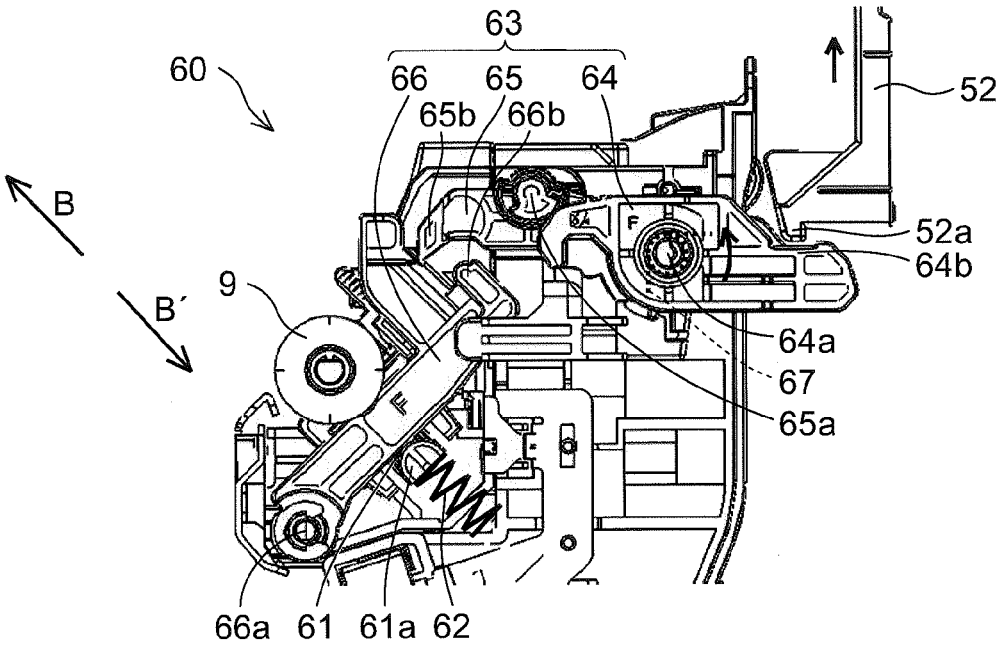
FIG. 12 is a diagram illustrating a structure of the second link mechanism and its periphery illustrated in FIG. 4.
Figure 13:
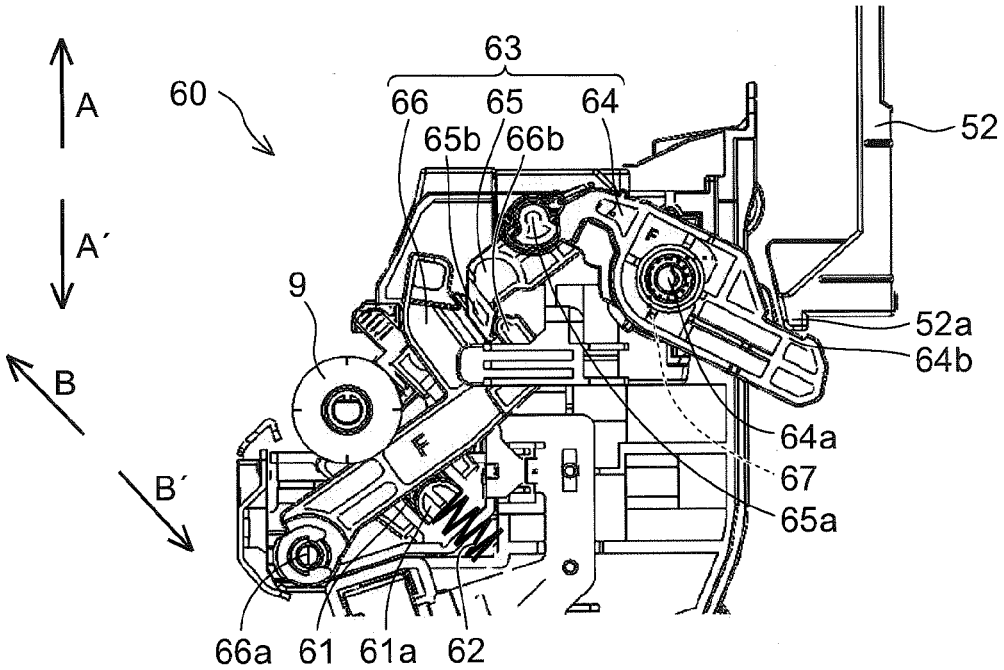
FIG. 13 is a diagram illustrating a structure of the second link mechanism and its periphery illustrated in FIG. 9.

At the lower end of the first link mechanism 52, as illustrated in FIG. 12, there is formed a lower end protrusion 52*a* that engages with a first rotation member 64 of a second link mechanism 63 described later. In the initial state, the lower end protrusion 52*a* is positioned at the position of FIG. 12, so that the lower end protrusion 52*a* and the first rotation member 64 are opposed to each other with a predetermined gap. In this state, the first link mechanism 52 is positioned at a pressure canceling position for canceling to press an engaging part 64*b* of the first rotation member 64. When the operating lever 51 is operated, as illustrated in FIGS. 9 and 13, the first link mechanism 52 is positioned at a pressing position at which the lower end protrusion 52*a* presses the first rotation member 64 in a downward direction.

Figure 14:
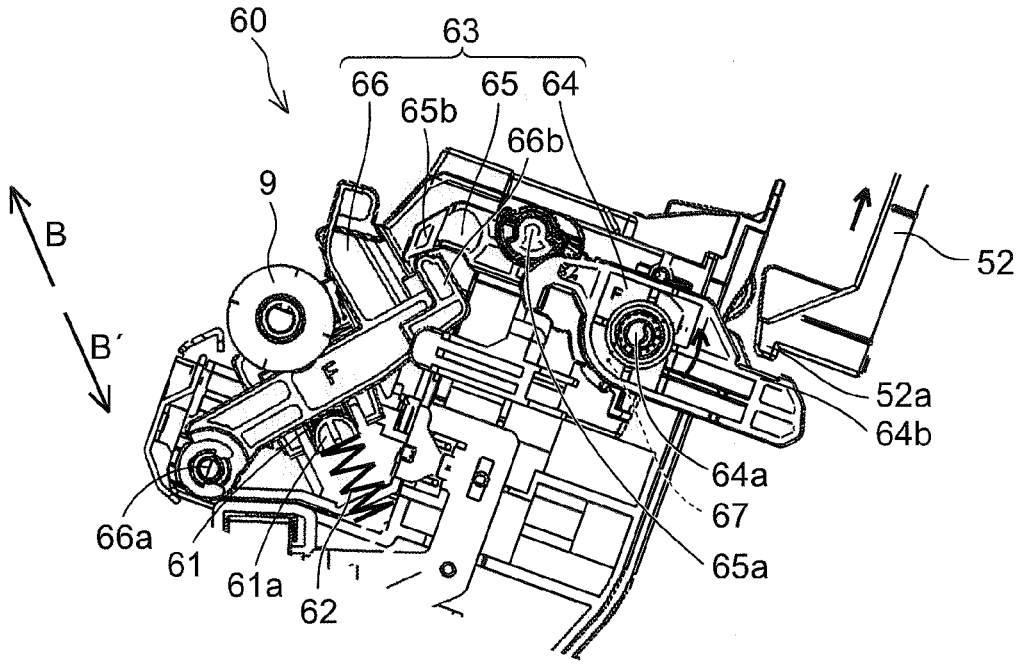
FIG. 14 is a diagram illustrating a structure of the second link mechanism and its periphery illustrated in FIG. 10.

In addition, when the operation of the operating lever 51 is canceled in the state where the cover member 50 is opened to the certain angle or larger, the lower end protrusion 52*a* is positioned at the position illustrated in FIGS. 10 and 14. In this way, a gap between the lower end protrusion 52*a* and the first rotation member 64 becomes larger than that in the initial state (the state of FIG. 12). In other words, when the conveying unit 60 rotates about the rotation shaft 60*a* in a counterclockwise direction in FIG. 2, the engagement between the engaging part 64*b* and the lower end protrusion 52*a* becomes shallow.

The torsion spring 54 (see FIG. 2) is wound around the rotation shaft 60*a*, and both ends thereof are attached in an opening direction between the conveying unit 60 and the cover member 50. Therefore, the torsion spring 54 biases the conveying unit 60 in a direction in which the double-sided conveying path 23 is opened (in a counterclockwise direction in FIG. 2). The torsion spring 54 is formed so that, when the operation of the operating lever 51 is canceled in the state where the cover member 50 is opened to the certain angle or larger (however, a state where the cover member 50 is opened to the maximum open angle is excluded), the conveying unit 60 is rotated in a counterclockwise direction against the weight of the conveying unit 60 and the engagement between the first link mechanism 52 and the first rotation member 64, and hence the double-sided conveying path 23 is opened with a predetermined space and is maintained in this state. Note that the apparatus main body (or the cover member 50) is provided with a rotation restricting part (not shown), which abuts the conveying unit 60 so as to restrict the rotation of the conveying unit 60 in a counterclockwise direction when the double-sided conveying path 23 is opened with a predetermined space.

On the other hand, the torsion spring 54 is formed so that, when the operation of the operating lever 51 is canceled in the state where the cover member 50 is opened to the maximum open angle, the conveying unit 60 cannot rotate in a counterclockwise direction because of the weight of the conveying unit 60 and the engagement between the first link mechanism 52 and the first rotation member 64.

In other words, when the conveying unit 60 is rotated in a counterclockwise direction with respect to the rotation shaft 60*a* (the double-sided conveying path 23 is opened) in the state where the cover member 50 is opened to the certain angle or larger, the conveying unit 60 rotates in a counterclockwise direction from the state of FIG. 14 to be a state where the engaging part 64*b* is positioned at the left side of the lower end protrusion 52*a*. From this state, the cover member 50 is opened to the maximum open angle and then the conveying unit 60 is pressed to rotate about the rotation shaft 60*a* in a clockwise direction. Then, the engaging part 64*b* moves to slide on the left underside of the lower end protrusion 52*a* and then is maintained at the position of FIG. 14. From this state, the pressure on the conveying unit 60 is canceled. Then the conveying unit 60 rotates a little in a counterclockwise direction, and the engaging part 64*b* engages with the lower end protrusion 52*a*. In this case, a total force of a rotating force of the conveying unit 60 about the rotation shaft 60*a* in a clockwise direction due to its weight and an engagement force between the lower end protrusion 52*a* of the first link mechanism 52 and the engaging part 64*b* of the first rotation member 64 becomes larger than a rotating force of the conveying unit 60 in a counterclockwise direction due to the biasing force of the torsion spring 54. Therefore, the conveying unit 60 cannot return (cannot rotate in a counterclockwise direction), and hence the engagement between the first rotation member 64 and the first link mechanism 52 is maintained. Note that the engagement force between the lower end protrusion 52*a* and the engaging part 64*b* in this case is the engagement force in the state where the engagement between the lower end protrusion 52*a* and the engaging part 64*b* becomes shallow as illustrated in FIG. 14.

As illustrated in FIGS. 3 and 12, the conveying unit 60 is constituted of a follower roller 14*a* of the registration roller pair 14, the secondary transfer roller 9, a bearing member (roller support part) 61 that supports both ends of the secondary transfer roller 9 in a rotatable manner, a compression spring (second biasing member) 62 that biases the bearing member 61 and the secondary transfer roller 9 in an arrow B direction (first direction) toward the apparatus main body, the second link mechanism 63 that engages with the lower end protrusion 52*a* of the first link mechanism 52 and moves the secondary transfer roller 9 interlocking with the operation of the first link mechanism 52, and the like.

Figure 15:
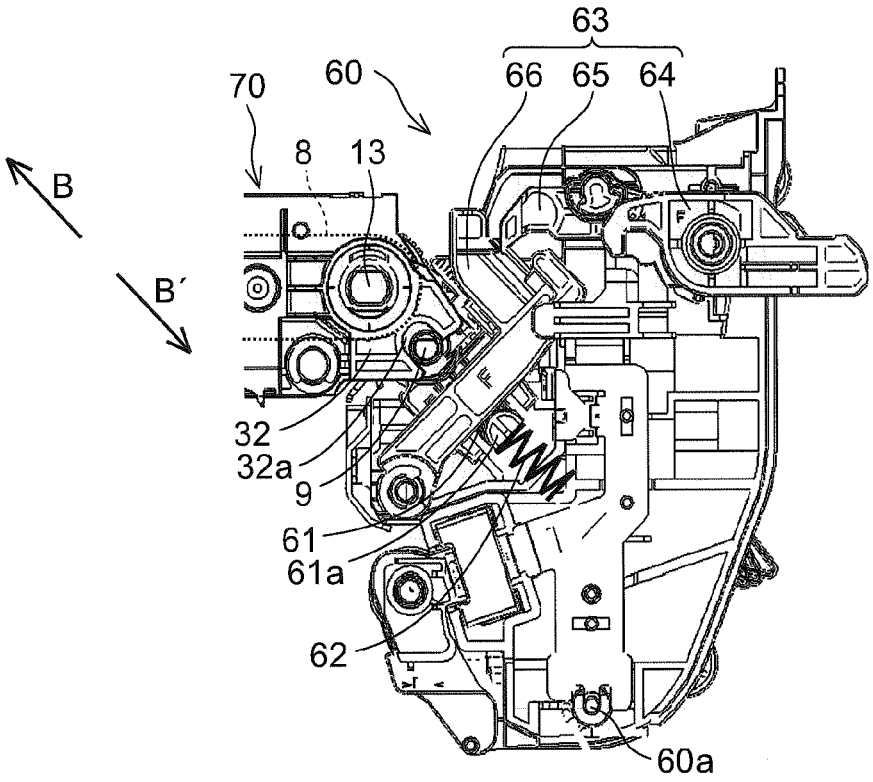
FIG. 15 is a diagram illustrating a structure of a conveying unit and its periphery of the opening/closing unit according to an embodiment of the present disclosure, in a state where a rotation shaft of a secondary transfer roller is positioned in an opening part of a support member.

As illustrated in FIG. 15, the secondary transfer roller 9 is pressed to the intermediate transfer belt 8 by the biasing force of the compression spring 62. The intermediate transfer unit (image carrier unit) 70 including the intermediate transfer belt 8 is provided with the support member 32 that supports both ends of the drive roller 13 in a rotatable manner. The support member 32 is provided with the opening part (bearing groove) 32*a* in which the rotation shaft of the secondary transfer roller 9 is fit. In the initial state (the state of FIGS. 2 and 15), the secondary transfer roller 9 is fit in the opening part 32*a* of the support member 32 (member provided to the apparatus main body) (engaging position), so as to be accurately positioned with respect to the drive roller 13.

As illustrated in FIG. 12, the bearing member 61 is formed to be able to move in an arrow BB' direction (expansion and contraction direction of the compression spring 62). In a part of the bearing member 61 on the compression spring 62 side, there is formed a semicircle protrusion 61*a* having a semicircular shape so as to protrude in a direction perpendicular to the paper surface of FIG. 12.

The second link mechanism 63 is constituted of the first rotation member 64 that rotates about a rotation shaft 64*a*, a second rotation member 65 that rotates about a rotation shaft 65*a*, and a rotating lever 66 that rotates about a rotation shaft 66*a*.

The first rotation member 64 includes an engaging part (second engaging part) 64*b* that engages with the lower end protrusion 52*a* of the first link mechanism 52. In addition, the first rotation member 64 is biased by a torsion spring 67 provided to the rotation shaft 64*a* in a counterclockwise direction in FIG. 12. Therefore, the first rotation member 64 is positioned at the position of FIG. 12 in the initial state. Note that the first rotation member 64 is provided with a restricting part (not shown) for restricting rotation in a counterclockwise direction over the position of FIG. 12. The first rotation member 64 is pressed by the first link mechanism 52 so as to rotate in a clockwise direction.

The second rotation member 65 has a gear part (not shown) that engages with a gear part (not shown) of the first rotation member 64 so as to interlocks with the first rotation member 64. When the first rotation member 64 rotates in a clockwise direction, the second rotation member 65 rotates in a counterclockwise direction. When the first rotation member 64 rotates in a counterclockwise direction, the second rotation member 65 rotates in a clockwise direction. In addition, a free end side of the second rotation member 65 rotating around the rotation shaft 65*a* is provided with an engaging ratchet 65*b* that engages with an engaging protrusion 66*b* formed on the side of the rotating lever 66 opposite to the rotation shaft 66*a*.

The rotating lever 66 is formed to abut the semicircle protrusion 61*a* of the bearing member 61. In the initial state (the state of FIG. 12), the rotating lever 66 is pressed by the semicircle protrusion 61*a* in the arrow B direction. As illustrated in FIG. 13, when the first rotation member 64 is pressed by the first link mechanism 52 in the arrow A' direction to rotate in a clockwise direction, the second rotation member 65 rotates in a counterclockwise direction so that the engaging ratchet 65*b* engages with the engaging protrusion 66*b*, and hence the rotating lever 66 rotates in a clockwise direction. In this way, because the bearing member 61 moves in an arrow B' direction against the biasing force of the compression spring 62, the rotation shaft of the secondary transfer roller 9 moves to the outside (retracted position) of the opening part 32*a* of the support member 32 (see FIG. 15), and hence an opening operation of the cover member 50 can be performed.

Next, the opening operation of the opening/closing unit 40 is described.

In the initial state (the state of FIGS. 2, 5 and 12), when the user pulls the handle 51*a* of the operating lever 51, the operating lever 51 rotates in a counterclockwise direction in FIG. 5. In this way, as illustrated in FIGS. 6 and 13, the engagement between the engaging member 51*b* of the operating lever 51 and the locking part 31 is released, and the first link mechanism 52 is moved in the arrow A' direction. Then, the first rotation member 64 is rotated in a clockwise direction by the first link mechanism 52, the second rotation member 65 is rotated in a counterclockwise direction, and the rotating lever 66 is rotated in a clockwise direction. In this way, the bearing member 61 moves in the arrow B' direction, and the rotation shaft of the secondary transfer roller 9 moves to the outside (retracted position) of the opening part 32*a* of the support member 32 (see FIG. 15).

Figure 16:
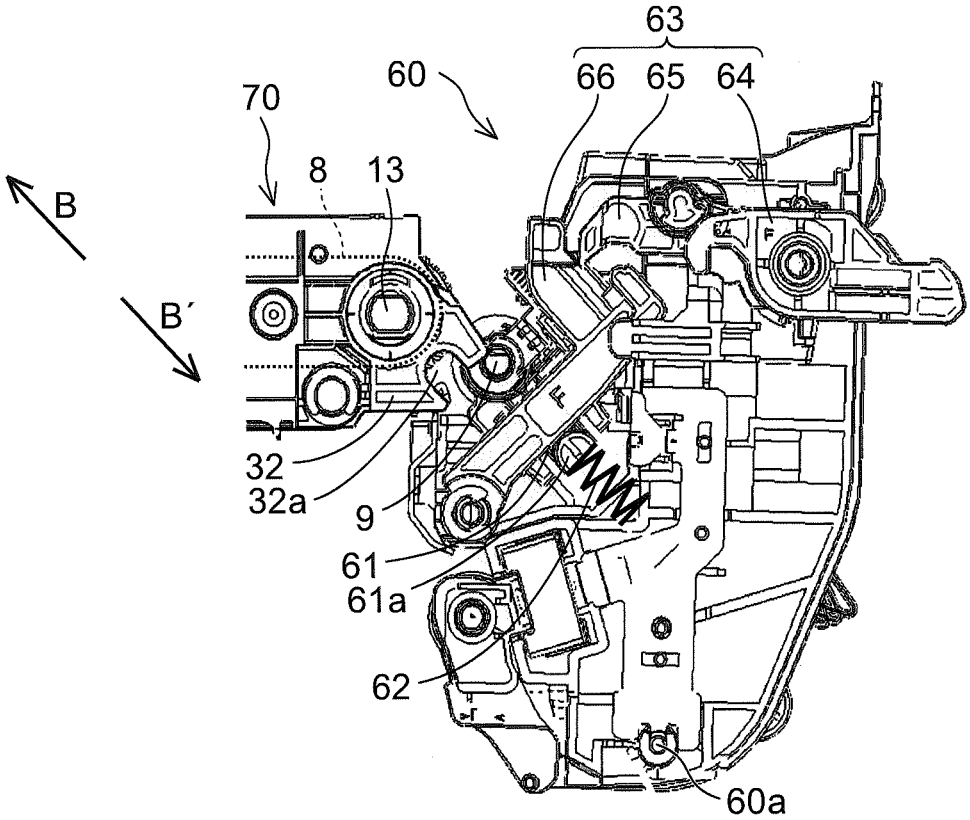
FIG. 16 is a diagram illustrating a structure of the conveying unit and its periphery of the opening/closing unit according to an embodiment of the present disclosure, in a state where the opening/closing unit is opened to a position at which the rotation shaft of the secondary transfer roller does not return to the inside of the opening part of the support member.

From this state, the cover member 50 is opened (rotated about the rotation shaft 50*a* in a clockwise direction). Then the paper sheet conveying path 19 is opened. Note that even if the user cancels the operation of the operating lever 51 during the opening operation of the cover member 50, the distal end part 51*e* of the operating lever 51 abuts the lower end of the locking part 31 as illustrated in FIG. 7, and hence the operating lever 51 does not return to the original state (an operation cancel state, a position at which the bottom surface becomes horizontal). Therefore, the rotation shaft of the secondary transfer roller 9 does not return to the inside of the opening part 32*a* of the support member 32 (the engaging position) as illustrated in FIG. 16.

When the operation of the operating lever 51 is canceled in the state where the cover member 50 is opened to the certain angle or larger, the engaging member 51*b* rotates a little in a clockwise direction from the initial state (the state of FIG. 5) as illustrated in FIG. 11, and the first link mechanism 52 moves a little in the arrow A direction from the initial state. In this way, the lower end protrusion 52*a* of the first link mechanism 52 is positioned at the position illustrated in FIG. 14, and hence a space between the lower end protrusion 52*a* and the engaging part 64*b* of the first rotation member 64 is increased.

In this case, the biasing force of the torsion spring 54 toward the conveying unit 60 is larger than the force of retaining the conveying unit 60 by the weight of the conveying unit 60 and the engagement between the lower end protrusion 52*a* and the engaging part 64*b*. In this way, the conveying unit 60 rotates about the rotation shaft 60*a* in a counterclockwise direction, and the engagement between the lower end protrusion 52*a* and the first rotation member 64 is released, and hence the double-sided conveying path 23 is opened with a predetermined space as illustrated in FIG. 3.

In this way, by the opening operation of the opening/closing unit 40, both the paper sheet conveying path 19 and the double-sided conveying path 23 are opened.

Figure 17:
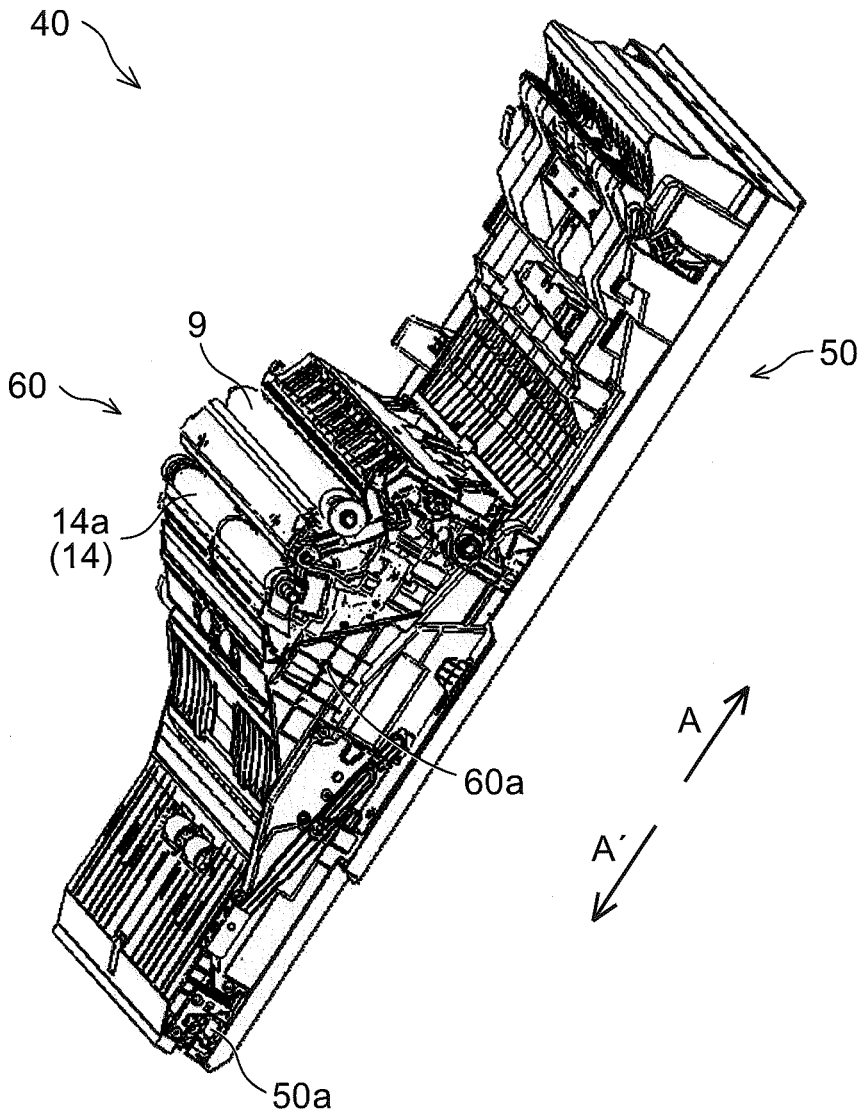
FIG. 17 is a perspective view illustrating a state where the conveying unit is pressed to the cover member in a state where the cover member of the opening/closing unit according to an embodiment of the present disclosure is opened to a maximum open angle.

In addition, when jamming occurs in the paper sheet conveying path 19, as illustrated in FIG. 17, the cover member 50 is opened to the maximum open angle, the conveying unit 60 is rotated about the rotation shaft 60*a* in a clockwise direction to press the cover member 50, so that the first rotation member 64 is engaged with the lower end protrusion 52*a* of the first link mechanism 52. In this way, because of the weight of the conveying unit 60 and the engagement between the lower end protrusion 52*a* and the engaging part 64*b*, the conveying unit 60 cannot return (cannot rotate in a counterclockwise direction), and hence the engagement between the first rotation member 64 and the first link mechanism 52 is maintained.

In this embodiment, as described above, by operating the operating lever 51 (to rotate to the second position) so that the cover member 50 is opened to the certain angle or larger, and in this state by canceling the operation of the operating lever 51 (to rotate to the first position), the engagement of the engaging part 64*b* with the first link mechanism 52 can be released. In addition, by the biasing force of the torsion spring 54, the conveying unit 60 rotates with respect to the cover member 50 so that the double-sided conveying path 23 is opened. In this way, only by opening the cover member 50 and releasing the hand (by performing the opening operation of the cover member 50), both the paper sheet conveying path 19 and the double-sided conveying path 23 can be opened. Thus, a remaining paper sheet can be easily found, and workability of an unjamming operation can be improved.

In addition, as described above, by operating the operating lever 51 in a state where the cover member 50 is closed (to rotate to the second position), the first link mechanism 52 and the second link mechanism 63 work so that the secondary transfer roller 9 moves to the arrow B' direction. In this way, because the rotation shaft of the secondary transfer roller 9 moves to the outside of the opening part 32*a* of the support member 32, the opening/closing unit 40 can be opened.

Note that when closing the cover member 50, without operating the operating lever 51, the rotation shaft of the secondary transfer roller 9 gets over an opening edge of the opening part 32*a* and is guided to the opening part 32*a* so as to be positioned at a predetermined position. Then, the state of FIGS. 2 and 15 is obtained.

In addition, as described above, when the operation of the operating lever 51 is canceled before the distal end part 51*e* of the operating lever 51 passes the locking part 31 in the opening operation of the cover member 50, the distal end part 51*e* abuts the locking part 31 so that the operating lever 51 is restricted from returning to the first position. In this way, even if the operation of the operating lever 51 is canceled before the distal end part 51*e* passes the locking part 31 when performing the opening operation of the cover member 50, the operating lever 51 is prevented from returning to the first position until the distal end part 51*e* gets over the locking part 31, namely until the position at which the rotation shaft of the secondary transfer roller 9 cannot return to the inside of the opening part 32*a* of the support member 32. Thus, it is possible to prevent the rotation shaft of the secondary transfer roller 9 from returning to the inside of the opening part 32*a* of the support member 32 so that the opening/closing unit 40 cannot be opened.

In addition, as described above, when the operation of the operating lever 51 is canceled in the state where the cover member 50 is opened, the first link mechanism 52 moves in the arrow A direction from the initial position, and hence the space between the first link mechanism 52 and the engaging part 64*b* of the first rotation member 64 is increased. In this way, the engagement of the engaging part 64*b* with the first link mechanism 52 can be easily released, and the conveying unit 60 is rotated with respect to the cover member 50 by the biasing force of the torsion spring 54 so that the double-sided conveying path 23 can be opened.

In addition, as described above, when the conveying unit 60 is pressed to the cover member 50 so that the engaging part 64*b* engages with the first link mechanism 52 in the state where the cover member 50 is opened to the maximum open angle, even if the pressure of the conveying unit 60 is canceled, the engagement between the engaging part 64*b* and the first link mechanism 52 is maintained by the weight of the conveying unit 60. In this way, because the paper sheet conveying path 19 can be opened to the maximum limit, workability of the unjamming operation in the paper sheet conveying path 19 can be more improved.

Note that the embodiment disclosed here is merely an example in every aspect and should not be interpreted as a limitation. The scope of the present disclosure is defined not by the above description of the embodiment but by the claims and includes all modifications within the meanings and the scope equivalent to the claims.

For example, there is described the example in which the present disclosure is applied to the tandem type color image forming apparatus as illustrated in FIG. 1, but the present disclosure is not limited to this. It is needless to say that the present disclosure can be applied to various image forming apparatuses including the opening/closing unit, such as a monochrome copier, a monochrome printer, a digital multifunction peripheral, and a facsimile machine.

In addition, in the above embodiment, there is described the example in which when the operation of the operating lever 51 is canceled in the state where the cover member 50 is opened, the space between the first rotation member 64 and the first link mechanism 52 becomes a little larger than the initial state. However, it is possible to adopt a structure in which the space between the first rotation member 64 and the first link mechanism 52 is further increased so that the first rotation member 64 and the first link mechanism 52 do not engage with each other.

What is claimed is:

1. An opening/closing unit comprising:

a cover member disposed in a rotatable manner with respect to one side surface of an apparatus main body, so as to open and close a sheet conveying path formed in the apparatus main body;

a conveying unit provided inside of the cover member in the apparatus main body in a rotatable manner; wherein the sheet conveying path includes a first conveying path formed between the conveying unit and the apparatus main body so as to convey a sheet, and a second conveying path formed between the conveying unit and the cover member so as to convey a sheet, the cover member includes an operating lever that has a first engaging part capable of engaging with a locking part of the apparatus main body and is rotatable between a first position and a second position, the first position allowing the first engaging part and the locking part to be engaged with each other in a state where the cover member is closed, the second position allowing the engagement between the first engaging part and the locking part to be released in a state where the cover member is closed, a first link mechanism that interlocks with operation of the operating lever, and a first biasing member that biases the conveying unit in a direction in which the second conveying path is opened, the conveying unit includes a second engaging part that engages with the first link mechanism by rotating the operating lever to the second position in a state where at least the second conveying path is not opened, the first link mechanism is positioned at a pressing position for pressing the second engaging part when the operating lever is rotated to the second position, and the first link mechanism is positioned at a pressure canceling position for canceling to press the second engaging part when the operating lever is rotated to the first position, when the operating lever is rotated to the second position in a state where the cover member is closed, engagement of the first engaging part with the locking part is released so that opening operation of the cover member can be performed, and when the operating lever is rotated to the first position in a state where the cover member is opened, engagement of the second engaging part with the first link mechanism can be released, and the conveying unit is rotated with respect to the cover member by a biasing force of the first biasing member, so that the second conveying path is opened.

2. The opening/closing unit according to claim 1, wherein the conveying unit includes a roller member that is biased in a first direction toward the apparatus main body, and a second link mechanism that includes the second engaging part and moves the roller member in cooperation with operation of the first link mechanism, and when the operating lever is rotated to the second position in a state where the cover member is closed, the first link mechanism and the second link mechanism operate so that the roller member moves in a direction opposite to the first direction.

3. The opening/closing unit according to claim 1, wherein the operating lever has an abutting part that is formed adjacent to the first engaging part and can abut the locking part, and after the operating lever is rotated from the first position to the second position in a state where the cover member is closed, when the operation of the operating lever is canceled before the abutting part passes the locking part in the opening operation of the cover member, the abutting part abuts the locking part so that the operating lever is maintained at the second position.

4. The opening/closing unit according to claim 1, wherein when pressure of the conveying unit is canceled after the conveying unit is pressed to the cover member so that the second engaging part is engaged with the first link mechanism, in a state where the cover member is opened to a maximum open angle, the conveying unit is maintained at a state of closing the second conveying path.

5. An image forming apparatus comprising:

the opening/closing unit according to claim 1;

an apparatus main body to which the opening/closing unit is provided in a rotatable manner; and an image forming portion provided in the apparatus main body.

6. An image forming apparatus comprising:

the opening/closing unit according to claim 2;

an apparatus main body to which the opening/closing unit is provided in a rotatable manner;

an image forming portion provided in the apparatus main body; and an image carrier provided in the image forming portion, wherein the roller member is a transfer roller disposed to face the image carrier, the image forming portion is provided with a bearing groove that extends in an approaching and separating direction with respect to the image carrier and receives a rotation shaft of the roller member, and the conveying unit includes a roller support part that supports the rotation shaft of the roller member in a movable manner along the bearing groove, a second biasing member that biases the roller member toward the image carrier via the roller support part, and a rotating lever that constitutes a part of the second link mechanism and moves the roller support part in a direction separating from the image carrier to detach from the bearing groove against a biasing force of the second biasing member.

7. An opening/closing unit comprising:

a cover member supported in one side surface of an apparatus main body in a rotatable manner, the cover member being capable of opening and closing inside of the apparatus main body;

a conveying unit provided inside of the cover member in the apparatus main body in a rotatable manner;

a first sheet conveying path formed between the conveying unit and the apparatus main body in a state where the cover member is closed;

a second sheet conveying path formed between the conveying unit and the cover member in a state where the cover member is closed;

a locking member that includes an operating lever and locks or unlocks the cover member in a state where the cover member is closed;

a first biasing member that biases the conveying unit in a direction opposite to an opening direction of the cover member; and a first link mechanism that interlocks with an operation of the operating lever, wherein the conveying unit includes a moving member that engages with a member provided to the apparatus main body and moves between an engaging position at which the conveying unit cannot rotate and a retracted position at which the conveying unit can rotate as being retracted from the engaging position, and a second link mechanism that is linked to the first link mechanism and moves the moving member, by operating the operating lever to release the lock in a state where the cover member is closed, the moving member moves to the retracted position, and by rotating the cover member together with the conveying unit in the opening direction, the first sheet conveying path is opened, and by canceling the operation of the operating lever in a state where the first sheet conveying path is opened, engagement between the first link mechanism and the second link mechanism is released by a biasing force of the first biasing member, and the conveying unit is rotated in a direction opposite to the cover member so that the second sheet conveying path is opened.

* * * * *